US008053658B2

(12) United States Patent
Tanaka et al.

(10) Patent No.: US 8,053,658 B2
(45) Date of Patent: Nov. 8, 2011

(54) ELECTRONIC MUSICAL INSTRUMENT USING ON-ON NOTE TIMES TO DETERMINE AN ATTACK RATE

(75) Inventors: Ikuo Tanaka, Hamamatsu (JP); Taro Umemoto, Hamamatsu (JP)

(73) Assignee: Roland Corporation, Shizuoka-Ken (JP)

( * ) Notice: Subject to any disclaimer, the term of this patent is extended or adjusted under 35 U.S.C. 154(b) by 248 days.

(21) Appl. No.: 12/361,506

(22) Filed: Jan. 28, 2009

(65) Prior Publication Data

US 2009/0249943 A1 Oct. 8, 2009

(30) Foreign Application Priority Data

Apr. 7, 2008 (JP) ..... 2008-098953

(51) Int. Cl.
*G10H 1/02* (2006.01)

(52) U.S. Cl. ..... 84/604; 84/609; 84/615; 84/627

(58) Field of Classification Search ..... 84/604
See application file for complete search history.

(56) References Cited

U.S. PATENT DOCUMENTS 4,332,183 A * 6/1982 Deutsch ..... 84/627
6,118,065 A * 9/2000 Haruyama ..... 84/609

FOREIGN PATENT DOCUMENTS

JP 2002032083 1/2002

OTHER PUBLICATIONS

Machine Translation of Japanese Publication No. JP2002032083, published Jan. 31, 2002, 22 pp.
Abstract of Japanese Publication No. JP2002032083, published Jan. 31, 2002, 1 pg.

* cited by examiner

*Primary Examiner* — Elvin G Enad
*Assistant Examiner* — Christopher Uhlir
(74) *Attorney, Agent, or Firm* — David W. Victor; Konrad Raynes & Victor LLP

(57) ABSTRACT

An electronic musical instrument includes: an input device that inputs a sound generation instruction to start generating a musical sound and a stop instruction to stop the musical sound; an on-on time timer device that measures a time difference between a first and second sound generation instructions; a gate time timer device that measures a time difference between the second sound generation instruction and a stop instruction; an attack characteristic setting device that sets an attack characteristic of the musical sound to have a shorter attack time as the time difference measured by the on-on time timer device becomes shorter; and a release characteristic setting device that sets a release characteristic of the musical sound generated to have a shorter release time as the time difference measured by the gate time timer device becomes shorter.

23 Claims, 4 Drawing Sheets

ELECTRONIC MUSICAL INSTRUMENT USING ON-ON NOTE TIMES TO DETERMINE AN ATTACK RATE

CROSS-REFERENCE TO RELATED FOREIGN APPLICATION

This application is a non-provisional application that claims priority benefits 5 under Title 35, Unites States Code, Section 119(a)-(d) from Japanese Patent Application entitled "ELECTRONIC MUSICAL INSTRUMENT" by Ikuo Tanaka and Taro Umemoto, having Japanese Patent Application Serial No. JP2008-098953, filed on Apr. 7, 2008, which application is incorporated herein by reference in its entirety.

BACKGROUND

1. Technical Field

Embodiments of the present invention generally relate to electronic musical instruments, and more particularly, to electronic musical instruments capable of applying to musical sounds specified envelopes that suit each musical performance method.

2. Related Art

Electronic musical instruments that change an envelope of a musical sound to be generated according to a performance method are known. Japanese Laid-open Patent Application 2002-32083 (Patent Document 1) describes an electronic musical instrument that measures the time from key depression to key release (i.e., the gate time) in a performance, judges the performance to be a staccato performance when the measured time is shorter than a predetermined value, and makes faster the release characteristic, which is the rate of muting the musical sound being generated, in response to the key release, compared to the release characteristic to be given when the performance is not a staccato performance.

However, there are variations in each performance method, and the performance of a real acoustic musical instrument cannot be faithfully simulated by simply changing the release characteristic in response to the time from key depression to key release. In particular, the characteristics of the time interval between a key depression and another key depression (on-on time) and the attack waveform to be generated when multiple keys are depressed generally simultaneously would not suit each performance method.

SUMMARY

In accordance with an advantage of some aspects of the invention, there is provided an electronic musical instrument by which an envelope that suits each performance method can be applied to musical sounds to be generated.

An electronic musical instrument in accordance with a first embodiment of the invention includes: an input device that inputs a sound generation instruction that instructs to start generating a musical sound and a stop instruction that instructs to stop the musical sound being generated by the sound generation instruction; a sound source that starts generation of a musical sound in response to the sound generation instruction, and stops generation of the musical sound in response to the stop instruction; an on-on time timer device that measures a time difference between a first sound generation instruction inputted in the input device and a second sound generation instruction inputted next to the first sound generation instruction; a gate time timer device that measures a time difference between the second sound generation instruction and a stop instruction that instructs to stop a musical sound generated in response to the second sound generation instruction; an attack characteristic setting device that sets an attack characteristic of the musical sound generated in response to the second sound generation instruction to have a shorter attack time as the time difference measured by the on-on time timer device becomes shorter; a release characteristic setting device that sets a release characteristic of the musical sound generated in response to the second sound generation instruction to have a shorter release time as the time difference measured by the gate time timer device becomes shorter; and an instruction device that instructs the sound source to start generation of a musical sound with an attack characteristic set by the attack characteristic setting device in response to an input of the second sound generation instruction by the input device, and instructs the sound source to stop generation of a musical sound with a release characteristic set by the release characteristic setting device in response to an input of the stop instruction by the input device. It is noted that the attack time is the time elapsed from the time when an envelope waveform starts rising upon instruction to start generation of a musical sound until the envelope waveform reaches its maximum value, and the release time is the time elapsed from the time when the musical sound being generated is instructed to stop until the envelope waveform reaches its minimum value (0).

In the electronic musical instrument in accordance with a first aspect of the first embodiment, the attack characteristic setting device may set an attack characteristic having a shorter attack time as the time difference measured by the on-on time timer device becomes shorter, when the time difference measured by the on-on time timer device is shorter than a first predetermined time, and the release characteristic setting device may set a release characteristic having a shorter release time as the time difference measured by the gate time timer device becomes shorter, when the time difference measured by the gate time timer device is shorter than a second predetermined time.

In the electronic musical instrument in accordance with a second aspect of the first embodiment, the attack characteristic setting device may set an attack characteristic of a musical sound to be generated in response to the second sound generation instruction to be generally identical with an attack characteristic of a musical sound generated in response to the first sound generation instruction, when the time difference measured by the on-on time timer device is shorter than a multiple stop judgment time having a predetermined time duration.

In the electronic musical instrument in accordance with a third aspect of the first embodiment, the attack characteristic setting device may set an attack characteristic of a musical sound to be generated in response to the second sound generation instruction to be generally identical with an attack characteristic of a musical sound generated in response to the first sound generation instruction, when the time difference measured by the on-on time timer device is shorter than a multiple stop judgment time having a predetermined time duration that is shorter than the first predetermined time.

An electronic musical instrument in accordance with a second embodiment of the invention includes: an input device that inputs a sound generation instruction that instructs to start generating a musical sound; a sound source that generates a musical sound in response to the sound generation instruction; an on-on time timer device that measures a time difference between a first sound generation instruction inputted in the input device and a second sound generation instruction inputted after inputting the first sound generation instruction; an attack characteristic setting device that sets an attack characteristic of a musical sound to be generated in response to the second sound generation instruction to be generally identical with an attack characteristic of a musical sound generated in response to the first sound generation instruction, when the time difference measured by the on-on time timer device is shorter than a multiple stop judgment time having a predetermined time duration, and sets an attack characteristic of a musical sound to be generated in response to the second sound generation instruction to have a shorter attack time as the time difference measured by the on-on time timer device becomes shorter, when the time difference measured by the on-on time timer device is greater than the multiple stop judgment time; and an instruction device that instructs the sound source to start generation of a musical sound with an attack characteristic set by the attack characteristic setting device in response to an input of the second sound generation instruction by the input device.

In the electronic musical instrument in accordance with an aspect of the second embodiment, the attack characteristic setting device may set an attack characteristic of a musical sound to be generated in response to the second sound generation instruction to have a shorter attack time as the time difference measured by the on-on time timer device becomes shorter, when the time difference measured by the on-on time timer device is longer than the multiple stop judgment time and shorter than a first predetermined time.

The electronic musical instrument in accordance with the first embodiment has the following effects. A so-called shredding performance in which successive multiple notes are rapidly played is a performance in which the on-on time that is a time difference between the starting time of a note and the starting time of the next note is short, and the gate time that is a time difference between the starting time of a note and the stopping time of the note is short. In a shredding performance, a plurality of musical sounds successively generated is each given an envelope waveform with short attack time and release time. As a result, overlapping among the musical sounds is suppressed, and the performance can be conducted with well-defined musical sounds, each of the sounds having a clear and tight contour. In this manner, musical sounds with an envelope waveform that suits each performance method can be generated.

According to the electronic musical instrument in accordance with the first aspect, in addition to the effects obtained by the first embodiment, the following effect can be obtained. For example, the first predetermined time may be set at a longest specified time in the on-on time in a shredding performance, and the second predetermined time may be set at a longest predetermined time in the gate time in a shredding performance. When the on-on time is shorter than the first predetermined time and the gate time is shorter than the second predetermined time, each musical sound with an envelope waveform that suits a shredding performance can be generated.

According to the electronic musical instrument in accordance with the second aspect, in addition to the effects obtained by the first embodiment, the following effect can be obtained. When multiple keys are generally simultaneously depressed in a performance, the attack characteristics of sounds in a multiple stop that are generally simultaneously generated become generally identical, such that consistent sounds in a multiple stop can be generated.

According to the electronic musical instrument in accordance with the third aspect, in addition to the effects obtained by the first embodiment, the following effect can be obtained. When multiple keys are generally simultaneously depressed in a performance, the attack characteristics of sounds in a multiple stop that are generally simultaneously generated become generally identical, such that consistent multiple stop sounds can be generated.

The electronic musical instrument in accordance with the second embodiment has the following effects. When multiple keys are generally simultaneously depressed in a performance, the attack characteristics of sounds in a multiple stop that are generally simultaneously generated become generally identical with one another, such that consistent multiple stop sounds can be generated. In a shredding performance with a short on-on time, a shorter attack time is set, such that overlapping among the musical sounds successively generated is suppressed, and the performance can be played with well-defined musical sounds, each of the sounds having a clear and tight contour. In this manner, musical sounds with an envelope waveform that suits each performance method can be generated.

According to the electronic musical instrument in accordance with an aspect of the second embodiment, in addition to the effects obtained by the second embodiment, the following effect can be obtained. In other words, by setting the first predetermined time at a longest predetermined time in the on-on time in a shredding performance, when the on-on time is longer than the multiple stop judgment time but shorter than the first predetermined time, a musical sound having an attack characteristic with a shorter attack time is generated as the on-on time becomes shorter, and thus the musical performance can be carried out with well-defined musical sounds, each of the sounds having a clear and tight contour.

DESCRIPTION OF EXEMPLARY EMBODIMENTS

Figure 1:
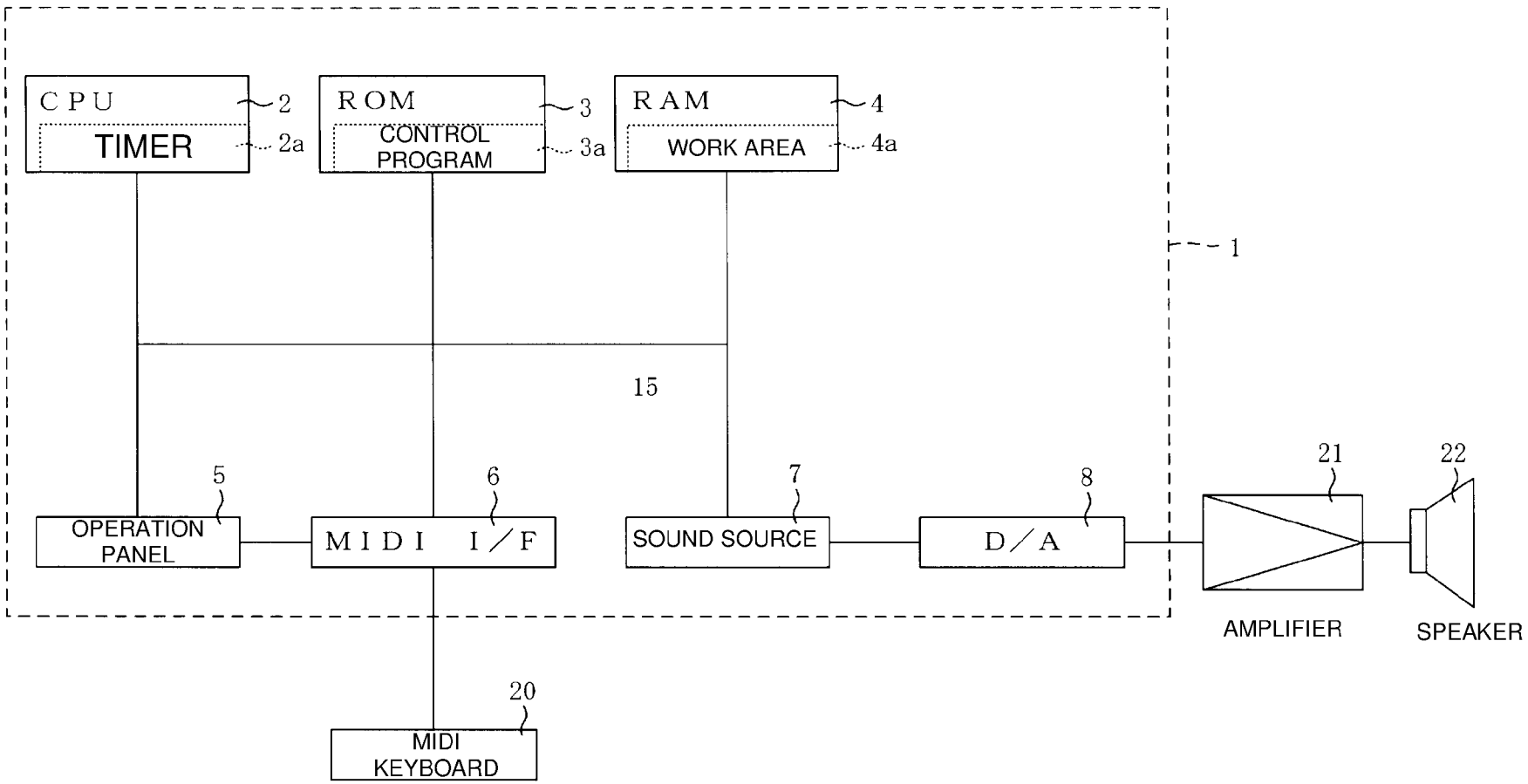
FIG. 1 is a block diagram of the electrical structure of an electronic musical instrument in accordance with an embodiment of the invention.

Preferred embodiments of the invention are described below with reference to the accompanying drawings. FIG. 1 is a block diagram of the electrical structure of an electronic musical instrument 1 in accordance with an embodiment of the invention. The electronic musical instrument 1 is capable of generating musical sounds that suit performance operations by, for example, a keyboard.

As shown in FIG. 1, the electronic musical instrument 1 is primarily provided with a CPU 2, a ROM 3, a RAM 4, an operation panel 5, a MIDI interface 6, a sound source 7, and a D/A converter 8. The CPU 2, the ROM 3, the RAM 4, the operation panel 5, the MIDI interface 6 and the sound source 7 are mutually connected through a bus line.

The CPU 2 controls each of the sections of the electronic musical instrument 1 according to fixed value data and control programs stored in the ROM 3 and RAM 4. The CPU 2 includes a timer 2*a* wherein the timer 2*a* counts clock signals, thereby measuring time. By the time measured by the timer 2*a*, an on-on time that is a time duration from an input of note-on information to an input of the next note-on information, and a gate time that is a time duration from an input of note-on information until an input of note-off information corresponding to the note-on information can be measured.

It is noted that the note-on information and the note-off information are information that conforms to the MIDI specification. The note-on information is information that is transmitted when a key of the keyboard is depressed and instructs to start generation of a musical sound, and is composed of a status indicating that the information is note-on information, a note number indicating a pitch of the musical sound, and a note-on velocity indicating a key depression speed. The note-off information is information that is transmitted when a key of the keyboard is released and instructs to stop generation of a musical sound, and is composed of a status indicating that the information is note-off information, a note number indicating a pitch of the musical sound and a note-off velocity indicating a key releasing speed.

The ROM 3 is a read-only (non-rewritable) memory, and may store a control program 3*a* to be executed by the CPU 2. The details of the control program 3*a* shall be described below with reference to a flow chart shown in FIG. 4. In addition to the control program 3*a*, the ROM 3 also stores fixed value data that may be referred to by the CPU 2 when executing the control program 3*a*.

The RAM 4 is a rewritable memory, and includes a work area 4*a* for temporarily storing various data when the CPU 2 executes the control program 3*a* stored in the ROM 3. The work area 4*a* stores the time at which note-on information is inputted, corresponding to a note number indicated by the note-on information. The stored time is referred to when the next note-on information is inputted, whereby an on-on time that is a time difference between the note-on information obtained now and the note-on information inputted immediately before. An attack rate of a musical sound to be generated based on the latest note-on information inputted is set according to the on-on time value, and the attack rate thus set is instructed to the sound source 7.

The attack rate is a coefficient for modifying the standard attack time, and a modified attack time can be obtained by the following formula:

$$\text{Attack Time(modified)}=\text{Standard Attack Time}\times\text{Attack Rate}+B$$

(B is a predetermined constant)

The time of inputting the note-on information is also referred to when note-off information is inputted. A gate time that is a time duration from the time of inputting the note-on information to the time when note-off information having the same note number as the note number of the note-on information is inputted is obtained, a release rate is set according to the value of the gate time, and the set release rate is instructed to the sound source 7.

The release rate is a coefficient for modifying the standard release time, and a modified release time can be obtained by the following formula:

$$\text{Release Time(modified)}=\text{Standard Release Time}\times\text{Release Rate}+C$$

(C is a predetermined constant)

It is noted that the standard attack time and the standard release time are set in advance for each timbre.

The operation panel 5 is provided with a plurality of operation members to be operated by the performer, and a display device that displays parameters set by the operation members and the status according to each performance.

As primary operation members, a variety of switches for selecting timbres of musical sounds to be generated, a volume controller for setting sound volumes, and the like.

The MIDI interface 6 is an interface that enables communications conforming to the MIDI standard, and a USB interface may also be used in recent years. The MIDI interface 6 is connected to a MIDI keyboard 20 having communication functions conforming to the MIDI standard. The MIDI keyboard 20 is provided with a plurality of white keys and black keys, outputs note-on information when any of the keys are depressed, and outputs note-off information when the keys are released.

The sound source 7 stores musical sound waveforms of a plurality of timbres of a variety of musical instruments, such as, a piano, a trumpet and the like, reads specified ones of the stored musical sound waveforms according to information sent from the CPU 2 instructing to start generation of musical sounds, and generates the musical sounds with a pitch, a volume and a timbre according to the instruction. Also, in response to information from the CPU 2 instructing to stop generation of musical sounds, the sound source 7 stops generation of the corresponding musical sounds. An envelope waveform is applied to a musical sound to be generated. An envelope waveform according to a specified attack rate is formed at an attack section of the envelope waveform, and an envelop waveform according to a specified release rate is formed at a release section thereof.

The attack rate and the release rate are instructed to the sound source 7 by the CPU 2. The envelope waveforms formed according to the attack rate and the release rate shall be described with reference to FIG. 2. The musical sound that is a digital signal formed by the sound source 7 is converted to an analog signal by the D/A converter 8, and outputted.

The D/A converter 8 is connected to an amplifier 21. The analog signal converted by the D/A converter 8 is amplified by the amplifier 21, and outputted as a musical sound from a speaker system 22 connected to the amplifier 21.

Figure 2A:
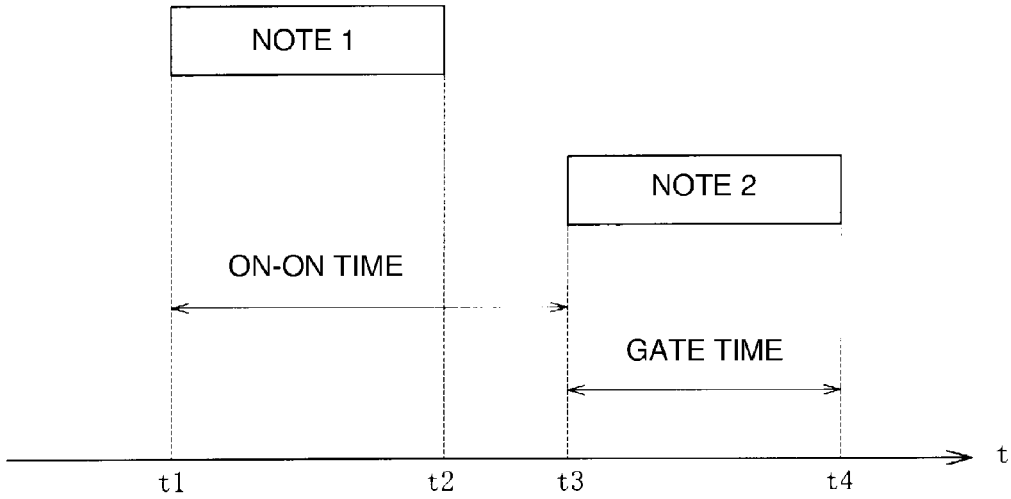
FIG. 2A shows the on-on time and the gate time.
Figure 2B:
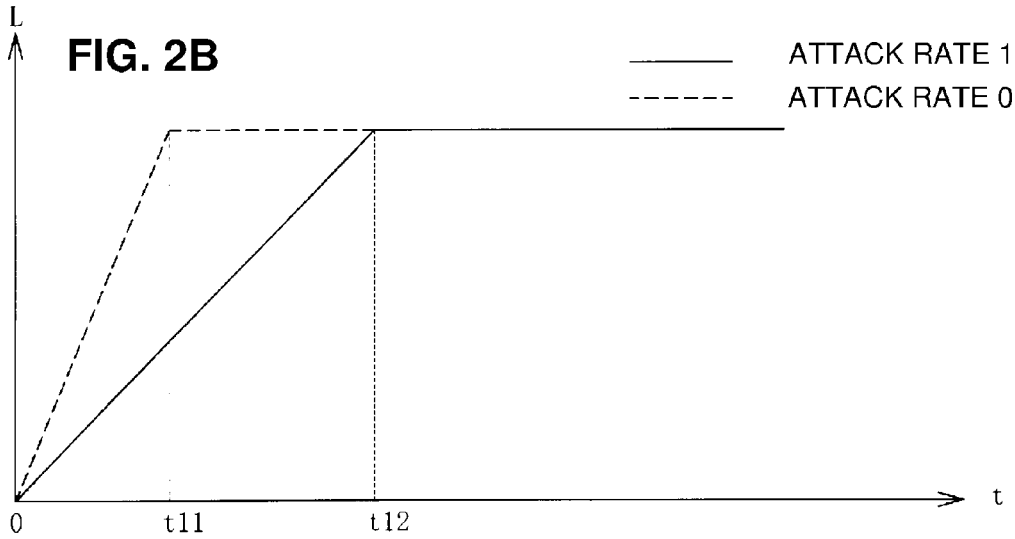
FIG. 2B is a graph showing envelope waveforms of attack sections according to different attack rates.
Figure 2C:
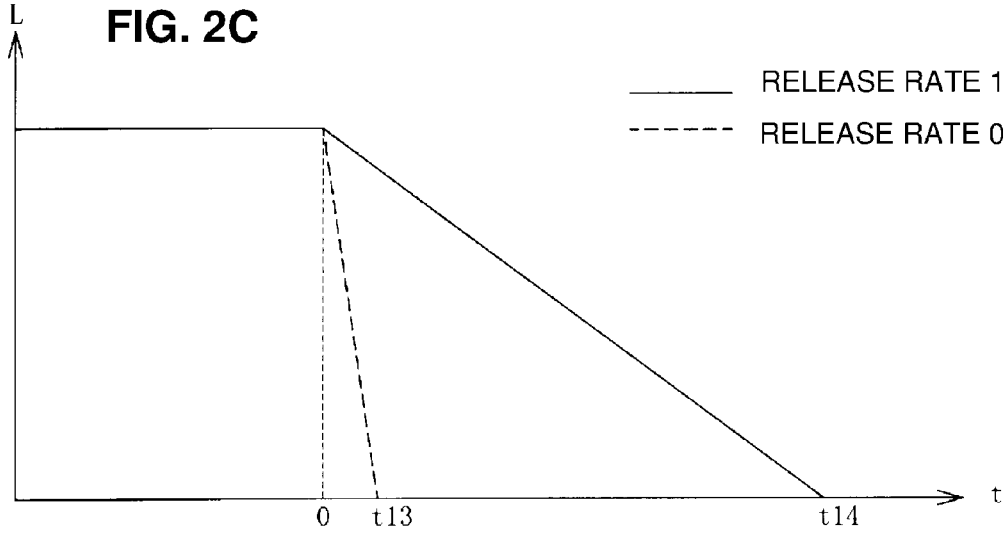
FIG. 2C is a graph showing envelope waveforms of release section according to different release rates.

A method for controlling envelope waveforms according to changes in the performance method in accordance with the present embodiment is described, referring to FIGS. 2A, 2B and 2C. FIG. 2A schematically shows a time series of note-on information and note-off information inputted. The states in which note-on information is inputted and note-off information corresponding to the note-on information is inputted next are indicated in the figure by rectangular boxes.

FIG. 2A shows the case in which note-on information of a note 1 is inputted at time t1, note-off information of the note 1 is inputted at time t2, note-on information of a note 2 is inputted at time t3, and note-off information of the note 2 is inputted at time t4. Also, as shown in FIG. 2A, a time duration from the time (t1) when note-on information of a note (note 1) is inputted to the time (t3) when note-on information of a next note (note 2) is inputted is referred to as an on-on time, and a time duration from the time (t3) when note-on information is inputted to the time (t4) when note-off information corresponding to the note-on information is inputted is referred to as a gate time.

FIGS. 2B and 2C are envelope waveform diagrams showing configurations of envelope waveforms that are to be added to musical sounds generated by the sound source 7. According to the state of performance, the CPU 2 instructs an attack rate and a release rate to the sound source 7, and an attack section of the envelope waveform is formed in response to the attack rate, and a release section of the envelope waveform is formed in response to the release rate. More specifically, an attack time of the envelope waveform is calculated based on the attack rate, and a release time of the envelope waveform is calculated based on the release rate.

FIG. 2B shows an envelope configuration of the attack section according to the given attack rate, and FIG. 2C shows an envelope configuration of the release section according to the given release rate, where the elapsed time is plotted on the axis of abscissas and the envelope level is plotted on the axis of ordinates.

When note-on information is inputted upon depression of a key, an on-on time that is a time duration from the time when the immediately preceding note-on information is inputted to the time when the latest note-on information is inputted is measured, and an attack rate is set according to the measured on-on time. More specifically, when the on-on time that is a time duration between the time of the last key depression and the time of the latest key depression is longer than a performance judgment time Th having a predetermined value, the attack rate is set at 1; and when the on-on time is shorter than the performance judgment time Th, the attack rate is set according to the following Formula A to an appropriate value (0-1) according to the on-on time:

$$\text{Attack Rate}=\text{On-on time}/Th \qquad \text{(Formula A)}$$

Then, the attack time is set by, for example, the following formula, as described above:

Attack Time=Standard Attack Time×Attack Rate+*B*

(B is a predetermined constant)

By this setting, a musical sound is generated with a shorter attack time, as the on-on time becomes shorter, such that unnecessary overlapping of musical sounds would become difficult to occur when notes are played rapidly, and the musical sounds can be performed with well-defined musical sounds, each of the sounds having a clear and tight contour.

As shown in FIG. 2B, when the attack rate is set at 1, the rising starts at time 0 and reaches a maximum value at time t12, as indicated by a solid line. The attack time in this case is t12. When the attack rate is set at 0, the rising becomes quicker, and the rising starts at time 0 and reaches the maximum value at time t11, as indicated by a broken line. The attack time in this case is t11.

On the other hand, when note-off information is inputted upon releasing the key, the release rate is set according to the time duration while the key is depressed. According to the release rate, the sound source 7 attenuates the level of the musical sound, and eventually stops generation of the musical sound. More specifically, a gate time that is a time duration from the time of key depression to the time of key releasing is measured. When the gate time is longer than a gate time threshold value GTh having a predetermined value, the release rate is set at 1. When the gate time is shorter than the gate threshold value GTh, the release rate is set by, for example, the following formula to an appropriate value (0-1) according to the gate time:

$$\text{Release Rate}=1-A\times(GTh-\text{Gate Time})/GTh$$

It is noted that A in the formula is a coefficient having a value between 0 and 1, and may be set according to each timbre. Then, the release time is set by, for example, the following formula, as described above:

Release Time=Standard Release Time×Release rate+*C*

(C is a predetermined constant)

As a result, a musical sound is generated with a shorter release time as the gate time becomes shorter, such that unnecessary overlapping of musical sounds would become difficult to occur when notes are played rapidly, and the performance can be conducted with well-defined musical sounds, each of the sounds having a clear and tight contour. In a shredding performance, the attack time may be made shorter and the release time is also made shorter, as described above, whereby more well-defined musical sounds can be generated.

As shown in FIG. 2C, when the release rate is set at 1, the attenuation starts at time 0 and reaches a minimum value 0 at time t14, as indicated by a solid line. The release time in this case is t14. When the release rate is set at 0, the attenuation becomes quicker, and the attenuation starts at time 0 and reaches the minimum value 0 at time t13, as indicated by a broken line. The release time in this case is t13.

Next, the case of a multiple stop performance in which multiple keys, like a chord, are generally simultaneously depressed is described with reference to FIG. 3. When an attack time is set according to a measured on-on time, as described above with reference to FIG. 2A, and in the case of a multiple stop in which multiple keys are depressed generally simultaneously, the on-on time becomes short for the second and later key depressions among the multiple key depressions, such that the attack rate calculated by using the aforementioned Formula A becomes small, and therefore the attack time would be consequently set short. However, unlike a shredding performance, in the case of a multiple stop performance in which multiple keys are depressed generally simultaneously, the more the multiple musical sounds composing a multiple stop rise in generally the same manner, the more consistent the multiple stop sounds can be generated. Therefore, when the on-on time is shorter than a multiple stop judgment time JT having a predetermined time duration, the attack rate for the second and later musical notes is set at generally the same attack rate of the leading musical sound. As a result, the musical sounds that are generated by generally simultaneous multiple key depressions rise generally in the same manner, such that consistent multiple stop sounds can be generated.

Figure 3:
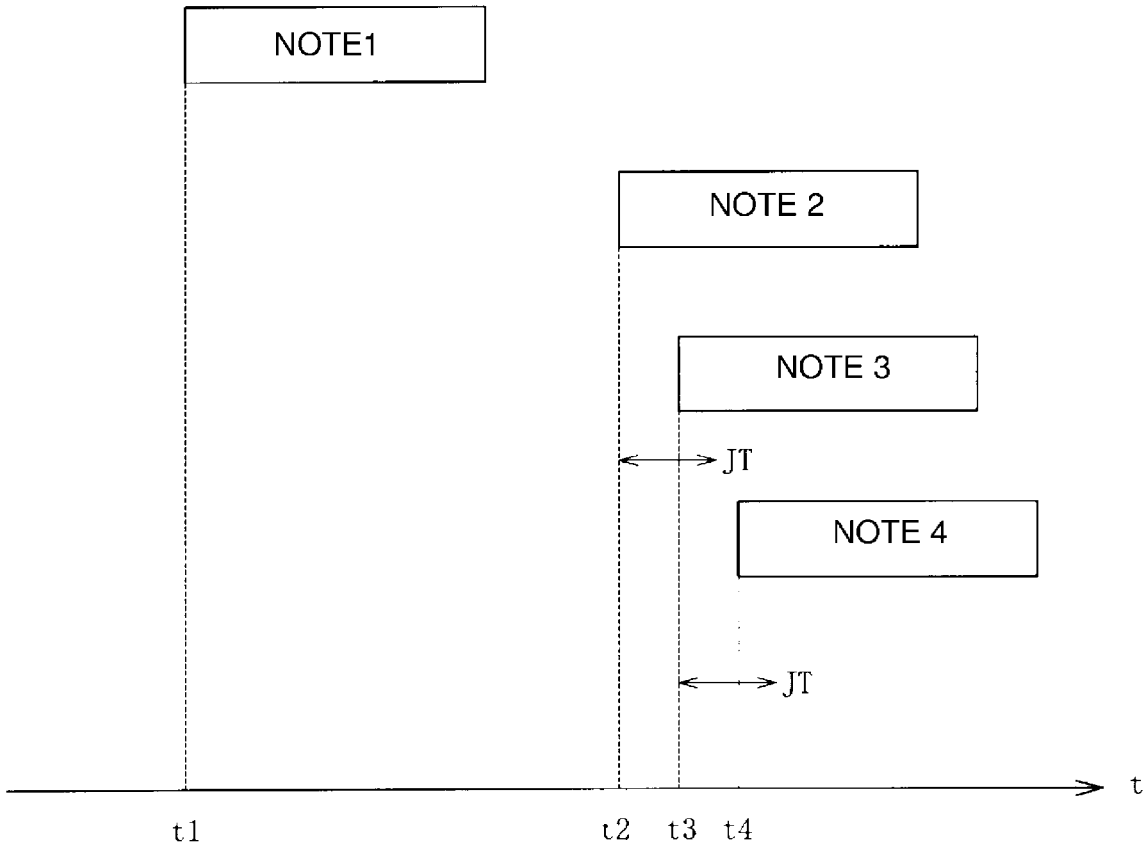
FIG. 3 schematically shows an event that is judged as a multiple stopping.

FIG. 3 schematically shows the state of key depression that may be judged as a multiple stop. In FIG. 3, the time is shown on the axis of abscissas and the time duration in which each key is depressed is shown by a rectangular box along the time axis. More specifically, the left end of each of the rectangular boxes indicates the time at which a key is depressed, and the right end of each of the rectangular boxes indicates the time at which the key is released. In this embodiment, an attack rate is set according to the time of key depression, and therefore the time of key release is not described. It is noted that musical notes are shown in a manner not to overlap each other along the axis of ordinates, and the axis of ordinates does not represent pitches of the musical sounds.

The state shown in FIG. 3 assumes that a note 1 is depressed at time t1, a note 2 is then depressed at time t2, a note 3 is then depressed at time t3, and then a note 4 is depressed at time t4. The state indicates that the on-on time that is a time difference between time t1 at which the note 1 is depressed and time t2 at which the note 2 is depressed is longer than a multiple stop judgment time JT having a predetermined time duration, the time difference from time t2 at which the note 2 is depressed to time t3 at which the note 3 is depressed is shorter than the multiple stop judgment time JT, and the time difference from time t3 at which the note 3 is depressed to time t4 at which the note 4 is depressed is also shorter than the multiple stop judgment time JT. In this case, the note 2 and the note 3 are judged to have been depressed generally at the same time, and the note 3 and the note 4 are also judged to have been depressed generally at the same time.

Accordingly, the attack rate of the note 2 is set to a value according to the on-on time between the note 1 and the note 2. However, the attack rate of the note 3 is set to generally the same value as the attack rate set for the note 2, and the attack rate of the note 4 is set to generally the same value as the attack rate set for the note 3. By this setting, the attack rates of the note 2, the note 3 and the note 4 become to be generally the same, such that note 2, the note 3, and the note 4 rise generally in the same manner and consistent sounds in a multiple stop can be generated.

Figure 4:
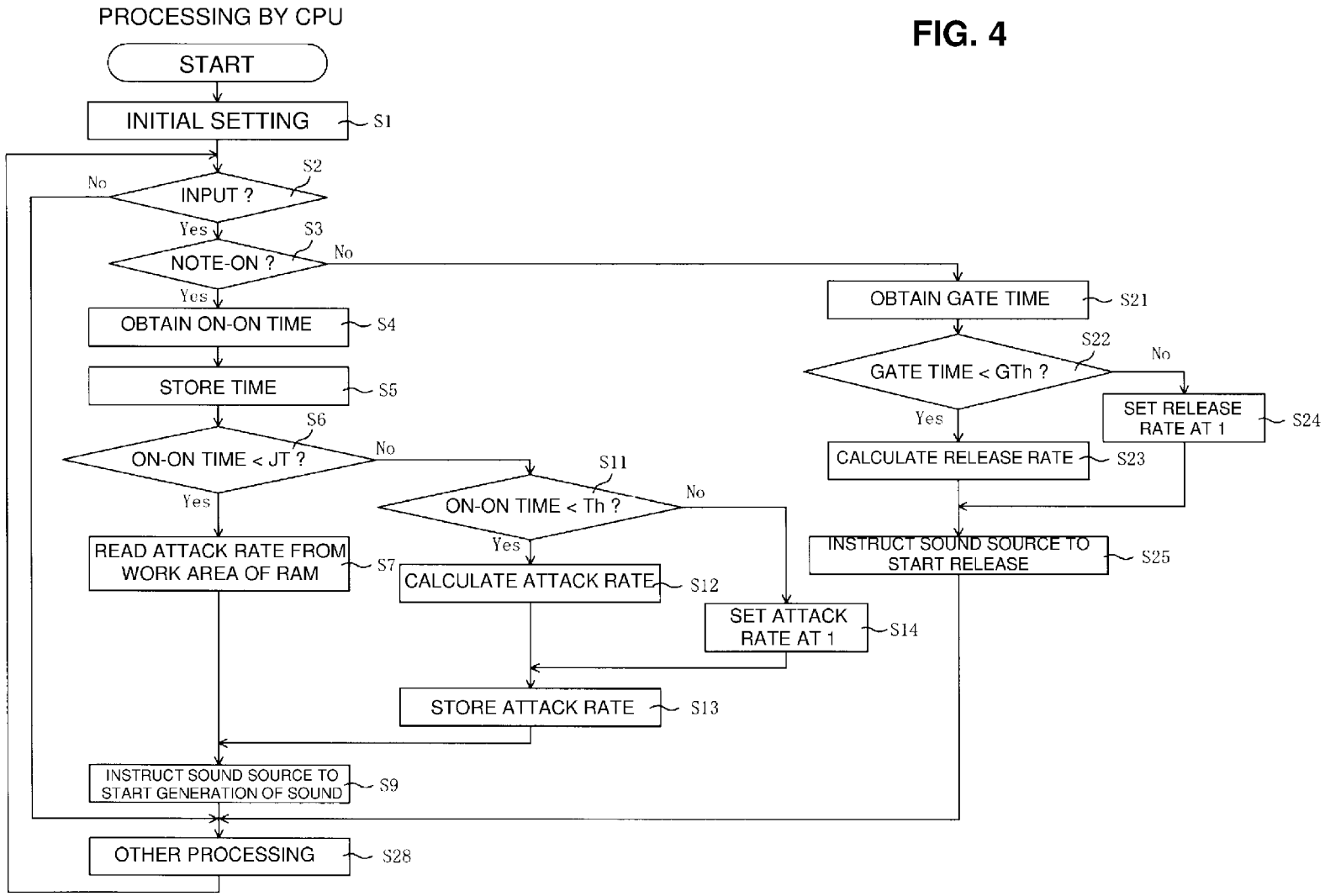
FIG. 4 is a flow chart showing processings to be executed by CPU.

Next, referring to FIG. 4, a process executed by the CPU 2 of the electronic musical instrument 1 is described. FIG. 4 is a flow chart of the process executed by the CPU 2. The process is started when the power on the electronic musical instrument 1 is turned on, and is repeated until the power is turned off.

In the process, first, an initial setting is performed (S1). As the initial setting, an attack rate stored in the work area 4*a* is initialized to 1, and the timer 2*a* is set to start measuring time. Next, it is judged as to whether performance information has been inputted in the MIDI input (S2). If performance information has been inputted (Yes in S2), it is judged as to whether the inputted information is note-on information (S3). In this embodiment, it is assumed that no information other than note-on information and note-off information is inputted.

When the inputted information is note-on information (Yes in S3), a time duration (hereafter referred to as an "on-on time") from the time at which note-on information was inputted last time to the time of the latest input of note-on information is obtained (S4). It is noted that, immediately after the power is turned on, the time of the last input of note-on information is not stored, and therefore the on-on time in this case is set to a time duration longer than the performance judgment time Th.

Next, the current time measured by the timer 2*a* is stored in the work area 4*a* of the RAM 4 according to the note number indicated by the note-on information (S5). Next, it is judged as to whether the on-on time obtained by the processing in S4 is shorter than the multiple stop judgment time JT (S6). If the on-on time is shorter than a multiple stop judgment time JT (Yes in S6), an attack rate for the last note-on stored in the work area 4*a* of the RAM 4 is read out, and the attack rate is instructed to the sound source 7 (S7).

When the on-on time is judged in the processing in S6 not to be shorter than the multiple stop judgment time JT (No in S6), it is judged that the note-on information does not belong to a multiple stop in which multiple keys are generally simultaneously played, and it is then judged as to whether the on-on time is shorter than a performance judgment time Th (S11). If the on-on time is shorter than the performance judgment time Th (Yes in S11), it is judged that a shredding performance was carried out, an attack rate according to the on-on time is calculated, the calculated attack rate is instructed to the sound source 7 (S12), and the attack rate stored in the work area 4*a* of the RAM 4 is changed to the calculated value (S13).

If the on-on time is not shorter than the performance judgment time Th (No in S11), the attack rate is set to 1 and instructed to the sound source 7 (S14), and the attack rate stored in the work area 4*a* of the RAM 4 is set to 1 (S13). When the processing in S7 or S13 is finished, the sound source 7 is instructed to start generation of a musical sound (S9).

On the other hand, if the information inputted in the judgment processing in S3 is not note-on information (No in S3), the inputted information is judged to be note-off information, and a gate time is obtained (S21). The time at which the note-on information was inputted is stored in the work area 4*a* of the RAM 4 according to the corresponding note number, and therefore the gate time can be obtained by subtracting the stored time from the current time.

Next, it is judges as to whether the gate time is shorter than a gate time threshold value GTh (S22). When the gate time is shorter than the gate time threshold value GTh (Yes in S22), a release rate is calculated, and the calculated release rate is instructed to the sound source 7 (S23). When the gate time is not shorter than the gate time threshold value GTh (No in S22), the release rate is set to 1, and instructed to the sound source 7 (S24). When the processing in S23 or S24 is finished, the sound source 7 is instructed to start releasing the musical sound (S25).

When it is judged in the judgment processing in S2 that performance information is not inputted (No in S2), or the processing in S9 or the processing in S25 is finished, other processing may be conducted (S28), and the process returns to the processing in S2.

The other processings include, for example, receiving information other than note-on information or note-off information, processing the information, detecting operations of the operation members, performing processings corresponding to the operations, and the like.

As described above, in accordance with an embodiment of the invention, when note-on information is inputted, an on-on time that is a time duration from the time at which note-on information was inputted last time is measured. When the on-on time is within the performance judgment time Th, it is assumed that a so-called shredding was performed, and an attack time is set faster (shorter) than the normal attack time; and when the gate time is judged to be shorter than the gate time threshold value GTh when note-off information is inputted, the release time is set faster (shorter). By this processing, when a so-called shredding is performed, musical sounds with appropriate attack waveform and release waveform can be generated.

When plural note-on information are inputted within a multiple stop judgment time JT, attack rates for waveforms to be formed based on the note-on information inputted after the leading note-on information are set to generally the same attack rate that is set for the leading waveform. This is effective in that the attack waveforms of musical sounds formed based on the plural note-on information approximate to one another, such that well-defined consistent multiple stop sounds can be generated.

It is noted that, in the embodiment described above, the attack rate does not depend on a value of note-on velocity included in note-on information. However, the attack rate may be modified according to a value of note-on velocity. In other words, the attack rate may be made smaller as the value of note-on velocity becomes larger, so that the level of a musical sound can rise greater and faster.

For example, when a velocity rate is VR, and a note-on velocity value is VL (the value ranges between 0 and 127 according to the MIDI standard), the following relation is established.

$$VR=(127-VL)/127$$

When $\alpha$ and $\beta$ are coefficients representing dependency rates for the on-on time and the note-on velocity VL, respectively, an attack rate may be provided by the following Formula B:

$$\text{Attack Rate}=\alpha\times(\text{On-on Time}/Th)+\beta\times VR \qquad \text{(Formula B)}$$

(For example, $\alpha+\beta=1$)

As a result, the attack rate can be set not only based on the on-on time, but also based on the value of note-on velocity VL. It is noted that Formula A represents the case where $\alpha=1$ and $\beta=0$ in Formula B.

An embodiment of the invention is described above. However, the invention is not at all limited to the embodiment described above, it can be readily understood that many changes can be made within the range that does not depart from the subject matter of the invention.

For example, in the embodiment described above, in the case of a judgment to be made as to whether note-on information belongs to a multiple stop caused by depressing multiple keys generally simultaneously, as indicated in FIG. 3, the following processings are conducted. When the on-on time from time t2 when the note 2 is depressed to time t3 when the note 3 is depressed is within the multiple stop judgment time JT, the note 2 and the note 3 are judged to belong to a double stop. Similarly, when the on-on time from time t3 when the note 3 is depressed to time t4 when the note 4 is depressed is within the multiple stop judgment time JT, the note 3 and the note 4 are judged to belong to a double stop. However, in a modified embodiment, the time measurement may be started from time t2 at which the note 2 is depressed, and a judgment may be made in a manner that all notes depressed within the multiple stop judgment time JT belong to a multiple stop.

Also, in the embodiment described above, for simplification of the description, the envelope waveform at the attack section is shown in a linear line, and the inclination of the linear line is assumed to change when the attack time is changed according to a different attack rate. However, in another modified embodiment, a plurality of curves with different rising configurations prepared according to different attack rates may be stored, and any of the curves may be selected. These curves may preferably be defined by monotonically increasing functions. Similarly, the release section may be in a curve, without being limited to a linear line.

Also, in the embodiment described above, when note-on events are judged to belong to a multiple stop in which multiple keys are depressed generally simultaneously, the attack rates for musical sounds of the second and later note-on events composing the multiple stop are generally matched with the attack rate of a musical sound of the leading event. However, in a still another modified embodiment, the attack rates for the second and later musical sounds may be slightly changed. For example, the attack rate for the second musical sound may be set to 95% of the attack rate of the leading musical sound, the attack rate for the third musical sound may be set to 95% of the attack rate of the second musical sound, and the like.

Furthermore, in the embodiment described above, when the note 2 and the note 3 are judged to belong to a multiple stop in which they are depressed generally simultaneously, as shown in FIG. 3, the attack rate for the note 3 is generally matched with the attack rate for the note 2, whereby the attack characteristic of the note 3 is set generally identical with the attack characteristic of the note 2. However, in a further modified embodiment, the attack characteristic of the note 3 may be set based on the on-on time between the note 1 and the note 3. Even when the attack characteristic of the note 3 is set based on the on-on time between the note 1 and the note 3, the attack characteristic of the note 3 is consequently set generally identical with the attack characteristic of the note 2 if the note 2 and the note 3 are depressed generally simultaneously in a multiple stop, because the attack characteristic of the note 2 is set based on the on-on time between the note 1 and the note 2.

What is claimed is:

1. An electronic musical instrument comprising:

an input device that inputs a sound generation instruction that instructs to start generating a musical sound and a stop instruction that instructs to stop the musical sound being generated by the sound generation instruction;

a sound source that starts generation of a musical sound in response to the sound generation instruction, and stops generation of the musical sound in response to the stop instruction;

an on-on time timer device that measures an on-on time difference between a first sound generation instruction inputted in the input device to generate a first musical sound and a second sound generation instruction inputted next to the first sound generation instruction to generate a second musical sound;

a gate time timer device that measures a gate time difference between the second sound generation instruction and a stop instruction that instructs to stop the second musical sound;

an attack characteristic setting device that sets an attack characteristic of the second musical sound to have a shorter attack time as the on-on time difference becomes shorter and that sets the attack characteristic of the second musical sound to be generally identical with an attack characteristic of the first musical sound when the on-on time difference is shorter than a multiple stop judgment time having a predetermined time duration;

a release characteristic setting device that sets a release characteristic of the second musical sound to have a shorter release time as the gate time difference becomes shorter; and an instruction device that instructs the sound source to start generation of the second musical sound with an attack characteristic set by the attack characteristic setting device in response to an input of the second sound generation instruction given by the input device and instructs the sound source to stop generation of the second musical sound with a release characteristic set by the release characteristic setting device in response to an input of the stop instruction given by the input device.

2. An electronic musical instrument according to claim 1, wherein the attack characteristic setting device sets an attack characteristic having a shorter attack time as the on-on time difference becomes shorter, when the on-on time difference is shorter than a first predetermined time, and the release characteristic setting device sets a release characteristic having a shorter release time as the gate time difference becomes shorter, when the gate time difference is shorter than a second predetermined time.

3. An electronic musical instrument according to claim 2, wherein the attack characteristic setting device sets an attack characteristic of the second musical sound to be generally identical with an attack characteristic of the first musical sound when the on-on time difference is shorter than a multiple stop judgment time having a predetermined time duration that is shorter than the first predetermined time.

4. An electronic musical instrument comprising:

an input device that inputs a sound generation instruction that instructs to start generating a musical sound;

a sound source that generates a musical sound in response to the sound generation instruction;

an on-on time timer device that measures an on-on time difference between a first sound generation instruction inputted in the input device to generate a first musical sound and a second sound generation instruction inputted to generate a second musical sound after inputting the first sound generation instruction;

an attack characteristic setting device that sets an attack characteristic of the second musical sound to be generally identical with an attack characteristic of the first musical sound when the on-on time difference is shorter than a multiple stop judgment time having a predetermined time duration, and sets an attack characteristic of the second musical sound to have a shorter attack time as the on-on time difference becomes shorter, when the on-on time difference is greater than the multiple stop judgment time; and an instruction device that instructs the sound source to start generation of the second musical sound with an attack characteristic set by the attack characteristic setting device in response to the input of the second sound generation instruction by the input device.

5. An electronic musical instrument according to claim 4, wherein the attack characteristic setting device sets an attack characteristic of the second musical sound to have a shorter attack time as the on-on time difference becomes shorter, when the on-on time difference is greater than the multiple stop judgment time and shorter than a first predetermined time.

6. A method, comprising:

determining an on-on time indicating a time difference between selection of a current note and a previous note in an electronic musical instrument;

determining whether the determined on-on time is less than a performance judgment time;

setting an attack rate for the current note to a first attack rate in response to determining that the on-on time is greater than the performance judgment time;

setting the attack rate for the current note to a second attack rate in response to determining that the on-on time is less than the performance judgment time;

setting the attack rate of the current note to have a shorter attack time as the on-on time becomes shorter;

setting the attack rate for the current note to be generally identical with the attack rate of the previous note when the on-on time is shorter than a multiple stop judgment time having a predetermined time duration calculating an attack time as a function of the set attack rate and a standard attack time, wherein the standard attack time is set in advance of the calculation and used in multiple calculations; and instructing a sound source in the electronic musical instrument to generate sound for the current note for the attack time.

7. The method of claim 6, wherein the first attack rate is a predetermined value, wherein the second attack rate is calculated as a function of the on-on time and the performance judgment time.

8. The method of claim 7, wherein the second attack rate comprises the determined on-on time divided by the performance judgment time, and wherein the attack time comprises the standard attack time times the set attack rate plus a constant.

9. The method of claim 7, further comprising:

determining a velocity rate of the current note, wherein the second attack rate is calculated as a function of the on-on time, the performance judgment time and the velocity rate of the current note.

10. The method of claim 6, further comprising:

determining whether the on-on time is less than a multiple stop judgment time;

wherein the operations of determining whether the determined on-on time is less than a performance judgment time and setting the attack rate based on the determination of whether the on-on time is greater than the performance judgment time is performed in response to determining that the on-on time is not less than the multiple stop judgment time.

11. The method of claim 10, further comprising:

setting the attack rate to a stored attack rate used for one note selected prior to the current note in response to determining that the on-on time is less than the multiple stop judgment time.

12. The method of claim 6, further comprising:

determining a gate time comprising a duration of time from when the current note was selected and released;

setting a release rate for the current note to a first release rate in response to determining that the gate time is greater than a gate time threshold;

setting the release rate for the current note to a second release rate in response to determining that the gate time is less than the gate time threshold;

calculating a release time as a function of the set release rate; and instructing a sound source to generate sound for the current note for the release time in response to the release of the current note.

13. The method of claim 12, wherein the first release rate is a predetermined value, wherein the second release rate is calculated as a function of the determined gate time and the gate time threshold value, and wherein the release time is a function of a standard release time and the set release rate.

14. The method of claim 13, wherein the second release rate comprises:

$$1-A\cdot(Gth-GT)/Gth,$$

wherein A comprises a coefficient between 0 and 1 set according to a timbre of the current note, wherein Gth comprises the gate time threshold, and wherein GT comprises the determined gate time, and wherein the release time comprises the standard release time times the release rate plus a constant.

15. A computer readable storage medium including a program executed by a processor to communicate with a sound source to produce sound in an electronic musical instrument and perform operations, the operations comprising:

determining an on-on time indicating a time difference between selection of a current note and a previous note;

determining whether the determined on-on time is less than a performance judgment time;

setting an attack rate for the current note to a first attack rate in response to determining that the on-on time is greater than the performance judgment time;

setting the attack rate for the current note to a second attack rate in response to determining that the on-on time is less than the performance judgment time;

setting the attack rate of the current note to have a shorter attack time as the on-on time becomes shorter;

setting the attack rate for the current note to be generally identical with the attack rate of the previous note when the on-on time is shorter than a multiple stop judgment time having a predetermined time duration calculating an attack time as a function of the set attack rate and a standard attack time, wherein the standard attack time is set in advance of the calculation and used in multiple calculations; and instructing the sound source to generate sound for the current note for the attack time.

16. The computer readable medium of claim 15, wherein the first attack rate is a predetermined value, wherein the second attack rate is calculated as a function of the on-on time and the performance judgment time.

17. The computer readable medium of claim 16, wherein the second attack rate comprises the determined on-on time divided by the performance judgment time, and wherein the attack time comprises the standard attack time times the set attack rate plus a constant.

18. The computer readable medium of claim 16, wherein the operations further comprise:

determining a velocity rate of the current note, wherein the second attack rate is calculated as a function of the on-on time, the performance judgment time and the velocity rate of the current note.

19. The computer readable medium of claim 15, wherein the operations further comprise:

determining whether the on-on time is less than a multiple stop judgment time;

wherein the operations of determining whether the determined on-on time is less than a performance judgment time and setting the attack rate based on the determination of whether the on-on time is greater than the performance judgment time is performed in response to determining that the on-on time is not less than the multiple stop judgment time.

20. The computer readable medium of claim 19, wherein the operations further comprise:

setting the attack rate to a stored attack rate used for one note selected prior to the current note in response to determining that the on-on time is less than the multiple stop judgment time.

21. The computer readable medium of claim 15, wherein the operations further comprise:

determining a gate time comprising a duration of time from when the current note was selected and released;

setting a release rate for the current note to a first release rate in response to determining that the gate time is greater than a gate time threshold;

setting the release rate for the current note to a second release rate in response to determining that the gate time is less than the gate time threshold;

calculating a release time as a function of the set release rate; and instructing a sound source to generate sound for the current note for the release time in response to the release of the current note.

22. The computer readable medium of claim 21, wherein the first release rate is a predetermined value, wherein the second release rate is calculated as a function of the determined gate time and the gate time threshold value, and wherein the release time is a function of a standard release time and the set release rate.

23. The computer readable medium of claim 22, wherein the second release rate comprises:

$$1-A\cdot(Gth-GT)/Gth,$$

wherein A comprises a coefficient between 0 and 1 set according to a timbre of the current note, wherein Gth comprises the gate time threshold, and wherein GT comprises the determined gate time, and wherein the release time comprises the standard release time times the release rate plus a constant.

* * * * *